US009390693B2

(12) United States Patent
Kasha

(10) Patent No.: US 9,390,693 B2
(45) Date of Patent: Jul. 12, 2016

(54) MUSICAL INSTRUMENT WITH OPPOSING ADJUSTABLE PITCH DRUMS

(71) Applicant: Robert James Kasha, Northridge, CA (US)

(72) Inventor: Robert James Kasha, Northridge, CA (US)

( * ) Notice: Subject to any disclaimer, the term of this patent is extended or adjusted under 35 U.S.C. 154(b) by 0 days.

(21) Appl. No.: 14/864,720

(22) Filed: Sep. 24, 2015

(65) Prior Publication Data

US 2016/0093276 A1 Mar. 31, 2016

Related U.S. Application Data

(60) Provisional application No. 62/055,420, filed on Sep. 25, 2014.

(51) Int. Cl.
*G10D 13/02* (2006.01)
*G10D 13/00* (2006.01)

(52) U.S. Cl.
CPC ..... *G10D 13/023* (2013.01); *G10D 13/00* (2013.01); *G10D 13/026* (2013.01)

(58) Field of Classification Search
CPC .... G10D 13/023; G10D 13/00; G10D 13/026
See application file for complete search history.

(56) References Cited

U.S. PATENT DOCUMENTS 4,048,895 A * 9/1977 May ..... G10D 13/028 84/411 A
4,278,003 A * 7/1981 Hanson ..... G10D 13/023 84/411 A
4,312,259 A * 1/1982 Henrit ..... G10D 13/023 84/411 A
4,596,176 A * 6/1986 Gauger ..... G10D 13/026 84/421
4,909,125 A * 3/1990 Fece ..... G10D 13/023 84/411 A
7,307,206 B2 * 12/2007 Payerl ..... F16M 13/02 84/421
8,927,842 B1 * 1/2015 Honjo ..... G10D 13/026 84/411 R

* cited by examiner

*Primary Examiner* — Robert W Horn
(74) *Attorney, Agent, or Firm* — Lewis Roca Rothgerber Christie LLP

(57) ABSTRACT

A musical instrument has at least a first rototom and a second rototom with their respective drum heads facing an opposite direction from each other. The musical instrument has two rototoms with each rototom having a first hoop supporting a drum head, a spider support with a second hoop, a tension hoop and an annulus. A generally horizontal shaft portion extends between the first hoop and the second hoop, wherein the spider support is movable on the shaft portion to vary a separation distance between the first hoop and the second hoop. A connector member is situated between the annuli of the first and second rototum to support the rototoms with their respective drum heads facing opposite directions.

20 Claims, 5 Drawing Sheets

MUSICAL INSTRUMENT WITH OPPOSING ADJUSTABLE PITCH DRUMS

CROSS-REFERENCE TO RELATED APPLICATIONS

This application claims priority to and the benefit of provisional U.S. Patent Application No. 62/055,420 filed Sep. 25, 2014, the entire content of which is incorporated herein by reference.

FIELD OF THE INVENTION

This invention relates to adjustable pitch drums and more particularly to two or more adjustable pitch drums arranged in a new and useful configuration.

BACKGROUND

A conventional drum typically comprises a hollow drum shell having two drum heads, each of which is held in place at opposite ends of the drum shell by head hoops. Conventional drums are usually not tunable except in a very narrow range by adjustment of the head hoop.

An adjustable pitch drum consists of a drum shell having an open end, a drum head pitch changing mechanism, and a supporting structure mounting the pitch changing mechanism to the drum shell. The pitch changing mechanism consists of a threaded rod adjustably threaded to the supporting structure, a drum head clamping hoop mounted coaxially on the rod for rotation thereabout, and a drum head tensioning hoop non-rotatably mounted on the other end of the rod. Rotation of the drum head and its clamping hoop about the rod varies the tension of the drum head on the tensioning hoop, thereby changing the pitch of the drum. Movement of the threaded rod in the supporting structure changes the spacing of the drum head from the drum shell open end, thereby changing the resonance characteristics of the drum assembly. A rototom is a designed adjustable pitch drum made by manufacturers around the world, including Remo, Inc. of California. The rototom is in public use and on sale but its written description may not be readily found in patents or published literature other than a limited amount of advertising literature available from various manufacturers.

FIG. 1 illustrates three rototoms 10A, 10B and 10C mounted in a series on a horizontal bar 22 supported by a stand 20, each facing in the same direction, namely, vertically upward. Each rototom has similar components and thus the following description of rototom 10A applies to rototoms 10B and 10C. As with typical rototoms, rototom 10A has a drum head or membrane 11 (often transparent) with an upper surface on which a drummer makes contact with drum sticks (not shown). The drum head 11 is mounted on a supporting hoop 14 with a threaded shaft 12 extending from an underside of the supporting hoop 14. A rigid multi-legged spider support 16 is secured on a threaded tubular support 18 which rides on the threaded shaft 12. Instead of adjusting each tension rod 19, rotation of the supporting hoop 14 about the shaft 12 in a direction by the drummer causes the threaded tubular support 18 to move upwardly or downwardly on the threaded shaft 12 so as to vary the tensioning force applied by the spider support 16 against the drum head or membrane 11 to tune the same. The rototoms 10A, 10B and 10C are generally linearly aligned on the horizontal support bar 22 with their respective drum heads or membranes 11A, 11B and 11C facing in a generally upward direction so that the drummer can strike the drumheads in a downward direction.

SUMMARY OF THE INVENTION

The present invention is directed to a musical instrument having at least a first rototom and a second rototom, with their respective drum heads facing an opposite direction from each other. In some embodiments, the musical instrument has two rototoms with each rototom having a first hoop supporting a drum head, and a spider support with a second hoop, a tension hoop and annulus, wherein the tension hoop is clamped on or positioned around the first hoop. The instrument also includes a generally horizontal shaft portion extending between the first hoop and the second hoop, wherein the spider support is movable on the shaft portion to vary a separation distance between the first hoop and the second hoop. The instrument further includes a connector member that is situated between the annuli of the first and second rototum.

In more detailed embodiments, the connector member has a vertical attachment portion, and the vertical attachment portion may have sections with different diameters.

In more detailed embodiments, the shaft portion of each rototom is connected to each other.

In more detailed embodiments, at least one drum head includes a mesh portion, and the mesh portion may include a target pad.

In other embodiments, the musical instrument of the present invention includes at least a first rototom and a second rototom, with each rototom having a first hoop supporting a drum head, a spider support with a second hoop, a tension hoop and an annulus, with the tension hoop positioned around the first hoop, and a generally horizontal shaft portion extending between the first hoop and the second hoop and through the annulus, wherein the spider support is movable on the shaft portion to change a separation distance between the first hoop and the second hoop. The musical instrument also includes a connector member situated between the annuli of the first and second rototum, with the connector member supporting each shaft portion.

In more detailed embodiments, the connector member is T-shaped with a horizontal body and a vertical portion extending from an underside of the horizontal body, and the connector member supports each rototom at generally a common elevation.

In additional embodiments, the musical instrument includes at least a first rototom and a second rototom, each rototom having a first hoop supporting a drum head, the first hoop having a first annulus, a spider support with a second hoop, a tension hoop and a second annulus, the tension hoop positioned around the first hoop, and a generally horizontal threaded shaft portion extending through the first and second annuli, wherein the spider support is rotatable on the shaft portion to change a separation distance between the first and second hoops. The musical instrument also includes a connector member situated between the second annuli of the first and second rototoms, wherein the drum head of the first rototom and the drum head of the second rototom are facing opposite directions.

In more detailed embodiments, the connector member has a vertical attachment portion.

In more detailed embodiments, the musical instrument includes a harness. The harness may have shoulder straps and a hip strap to enable a user to carry the musical instrument hands free.

BRIEF DESCRIPTION OF DRAWINGS

These and other features and advantages of the present invention will be better understood by reference to the following detailed description when considered in conjunction with the accompanying drawings wherein.

DETAILED DESCRIPTION OF THE INVENTION

Figure 2:
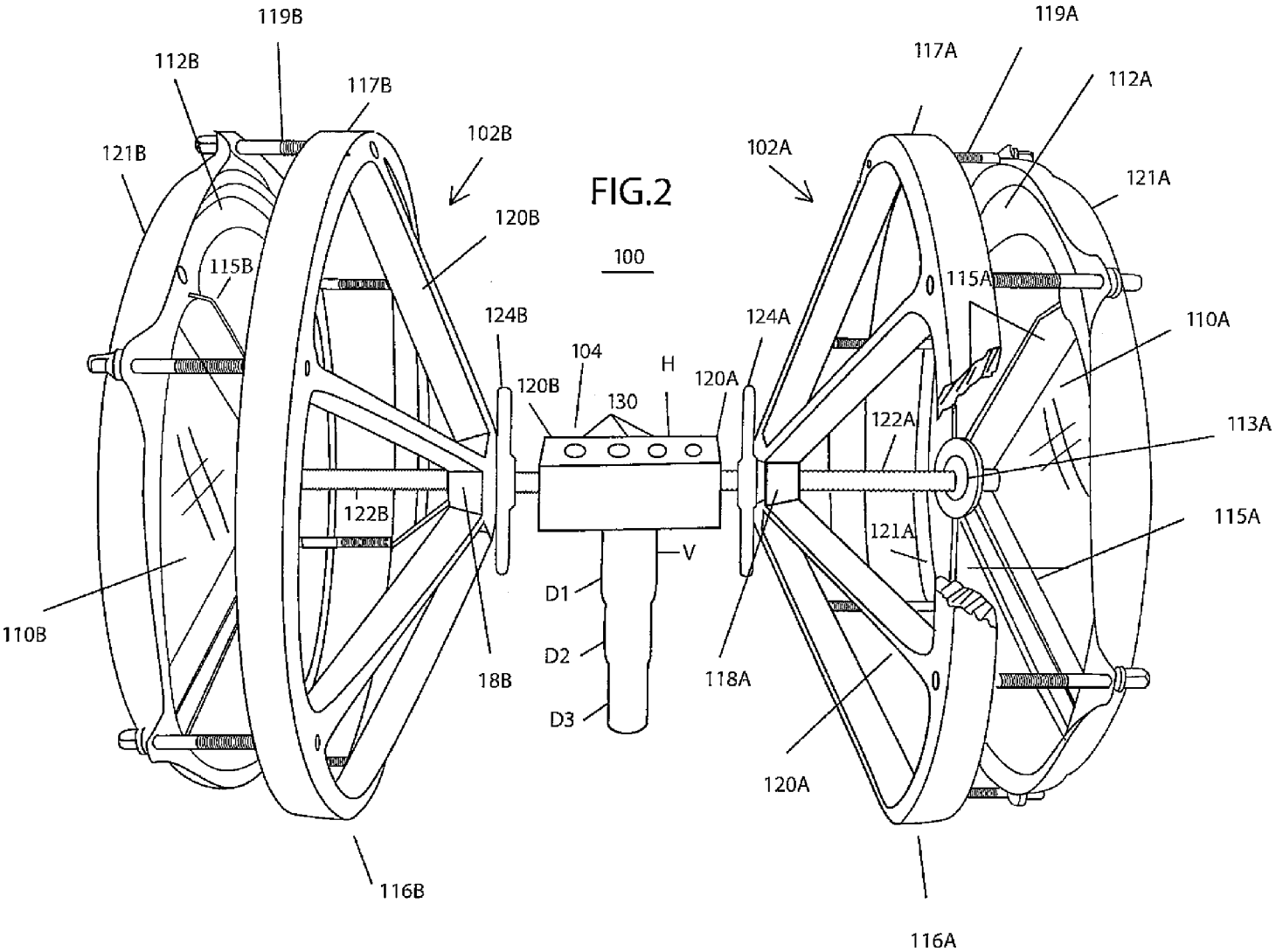
FIG. 2 is a front perspective view of a device of the present invention in accordance with one embodiment, with part(s) broken away.

The present invention includes musical instruments or practice drum instruments, and companions for marching bass drummers or other drummers. As shown in FIG. 2, the instrument 100 of the present invention includes at least two rototoms 102A and 102B and a connector member 104 connecting the two rototoms. In some embodiments, the connector member includes a T-shaped bracket that mounts the two rototoms horizontally in a "back to back" configuration with the rototoms opposite of each other, wherein each drum head or membrane 110A and 110B generally spans a respective vertical plane, generally at the same elevation, and facing a horizontal direction, generally oppositely and outwardly away from each other. Thus, each opposing drum head radiates sound waves toward each other creating a musical sound or simulating a marching bass drum. In some embodiments, the vertical planes spanned by each head 110A and 110B are generally parallel with each other. As a practice device, the instrument is designed to closely simulate the feel of marching style bass drums of most every diameter size.

Figure 3:
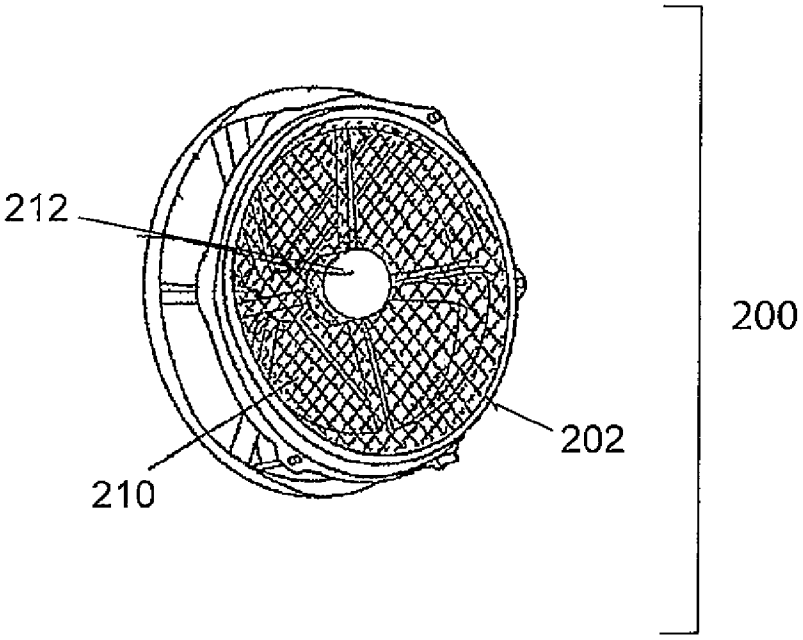
FIG. 3 is a front perspective view of a device of the present invention in accordance with another embodiment.

As shown in FIG. 3, alternate embodiments of an instrument 200 of the present invention improve technique without ear damaging volume by providing a drum head comprising a mesh 210 made of fabric or elastic material, with a target impact pad 212 that creates a quiet articulate sound that is still audible.

Regardless of whether the drum head is of mesh construction or otherwise, the rototoms of the present invention allow easy adjustability of head tension that can simulate a real drum feel rebound response, by rotation of the spider supports 116, for any bass drums ranging between about 8"-40", without having to adjust each tension point (tension rods). As a practice marching bass drum, the rototoms of the present invention are arranged with the left and right membranes spaced apart by 14 inches ("14 wide Head to Head"), which is standard in the marching industry for bass drums. The present invention however is not limited to this dimension, as explained below. Moreover, the rototoms can come in any size diameter available, ranging from 8 to 40".

In some embodiments of the present invention, the instrument can be adapted to any marching harness or carrier or stationary stand. The drum heads can be changed to any type of industry standard membrane such as Mylar or PVC type drum heads that can create a musical sound.

As the rototoms 102A and 102B share a similar construction, the following description of rototom 102A applies to rototom 102B. Membrane or drum head 110A is stretched on or over a first/outer hoop 112A which has a first, outer center annulus 113A, and multiple spokes 115A that connect the outer hoop 112A and the center annulus 113A. Inward of the first hoop 112A is a spider support 116A which has a second/inner hoop 117A, a second, inner center annulus 118A, and multiple spokes 120A that connect the inner hoop 117A and the inner center annulus 118A. The first and second annuli 106A and 118A are axially aligned such that the outer and inner hoops 112A and 117A are mounted on a horizontal shaft (or shaft portion) 122A that extends through the first and second center annuli 113A and 118A. The spider support 116A also has a tension hoop 121A that is supported by multiple tension rods 119A extending between the tension hoop 121A and the inner hoop 117A, connecting these hoops. The tension hoop 121A sits on (for example, is clamped on) the outer hoop 114A, opposing it, and applying pressure on the membrane 110A via the tension rods 119A and thus stretching the membrane 110A against the outer hoop 112A. A releasable fastener 124A, for example, a locking wing nut, is provided on the shaft 122A, adjacent (for example, inward of) the inner annulus 118A of the spider support 116A to releasably lock the spider support in a desirable position on the shaft 122 so as to maintain a selected distance between the inner hoop 117A and the outer hoop 112A and thus a selected tension on the membrane 110A.

The pressure exerted on the membrane 110A by the outer hoop 112A is adjustable by rotation of the spider support 116A which either moves the inner hoop 117A closer to the outer hoop 112A to decrease tension when the spider support 116A is rotated in one direction, or moves the inner hoop 117A away from the outer hoop 112A to increase tension when the spider support 116A is rotated in the opposition direction. Thus, the pitch of the rototom is set and tuned in this manner. The releasable fastener 124A may be loosened to allow adjustment and rotation of the spider support 116A on the shaft 122A and is tightened to lock the spider support 116A in another selected position on the shaft 122A.

The connector member 104 of some embodiments of the present invention, as shown in FIG. 2, has a horizontal portion H, and a vertical portion V extending downwardly from an underside of the portion H at a generally perpendicular angle from a midpoint of the horizontal portion H. The horizontal portion H facilitates a predetermined spacing (for example, 14 inches) between the two drum heads 110A and 110B and allows the rototoms 102A and 102B to be mounted "back to back" with each drum head facing outwardly in opposite directions. Each end 120A and 120B of the horizontal portion H has an aperture 125 to receive and/or is otherwise connected to a respective proximal end of the threaded shaft portions 122A and 122B of each rototom, thereby supporting the threaded shaft portions and thus the rototoms horizontally and facing outwardly in generally opposite directions. The horizontal portion H may have dimensions of about 1.25"×1.25"×6".

Figure 4:
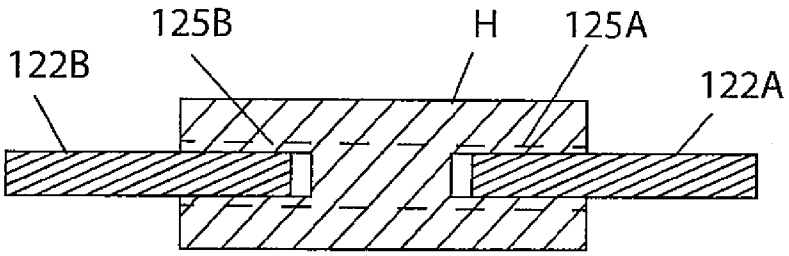
FIG. 4 is a top plan view of a connector member of the present invention in accordance with one embodiment.
Figure 5:
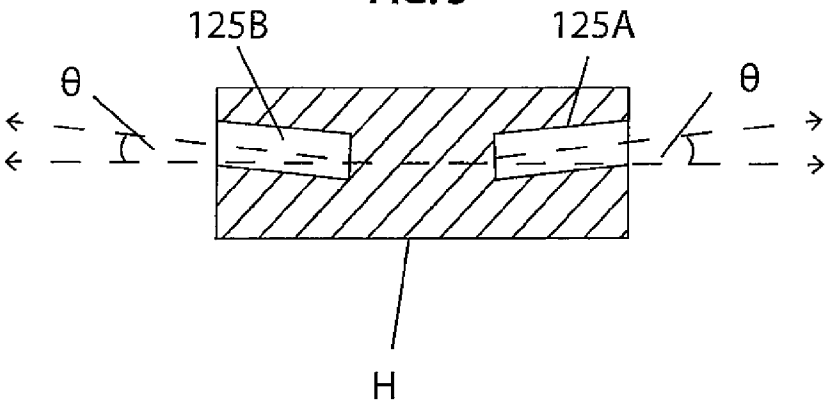
FIG. 5 is a top plan view of a connector member of the present invention in accordance with another embodiment.

In some embodiments, as shown in FIG. 4, where the threaded shafts portions 122A and 122B of each rototom are separate components, the apertures 125A and 125B are threaded so that the depth at which each threaded shaft portion is inserted and anchored in the horizontal portion H of the connector member 104 is adjustable. Thus, a separation distance between the two opposing drum heads 110A and 110B is adjustable by adjusting the depth at which either or both threaded shaft portions are mounted in the connector member 104. Moreover, the apertures 125A and 125B may be angularly offset by an angle θ from a horizontal axis through the length of the horizontal portion H such that each aperture 125A and 125B allows the shaft portions 122A and 122B to be canted forward and/or rearward, as desirable or appropriate, as shown in FIG. 5.

It is also understood that the apertures 125A and 125B may be in communication and connected to each other in forming a continuous through-hole (shown in broken lines in FIG. 4) extending the length of the horizontal portion H, and the threaded shaft 122A and 122B of each rototom may be two portions of a continuous shaft (shown in broken lines in FIG. 4) extending through the through-hole.

Figure 1:
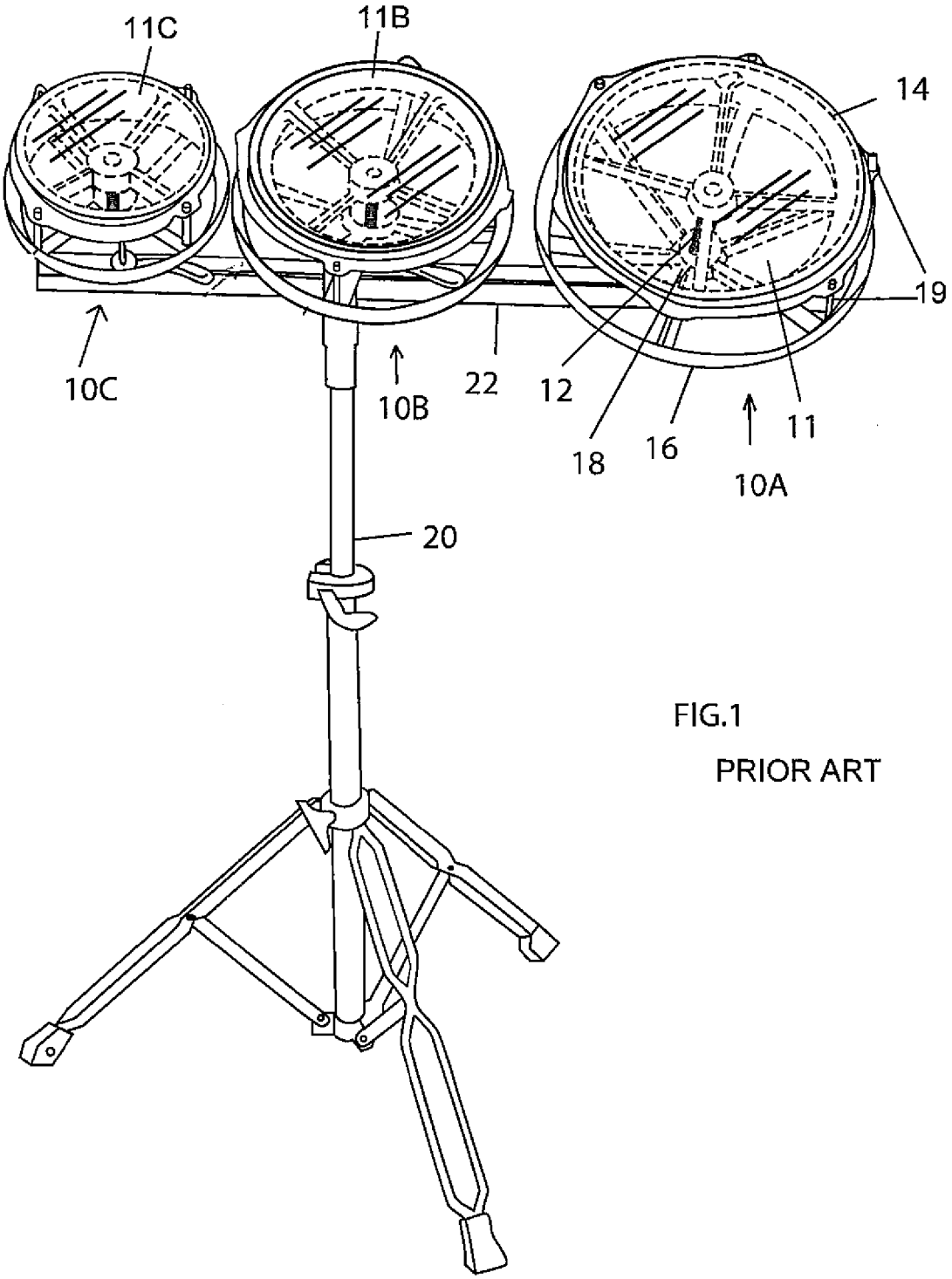
FIG.1 PRIOR ART
FIG. 1 is a perspective view of a plurality of rototoms mounted on a stand, as known in the art.

As shown in FIG. 1, an upper surface of the horizontal portion H may have one or more circular indentations or holes 130 with chaffered edge adapted to hold drum sticks or mallets when not in use. Each hole 130 may have a diameter of about 0.80".

A vertical portion (for example, a tubular post) V of the connector member 104 has a multi-stepped configuration with multiple graduating diameters, for example, with a largest diameter closest to the horizontal portion H, a middle diameter below the largest diameter, and a smallest diameter at the distal or bottom end of the vertical portion V). In some embodiments, the graduating diameters, for example, D1, D2 and D3, are about 1", ⅞" and ¾". The vertical portion V may be hollow or solid and may have a length of about 9". The graduating diameters adapt the bracket 104 for attachment onto a musical stand base or harness, for example, cymbal stand base or marching harness, which may have female receiving members with different sizes and/or diameters. The device of the present invention or the connector member is not limited to rototoms and can also be adapted to any other drum configuration or percussion device.

Figure 6:
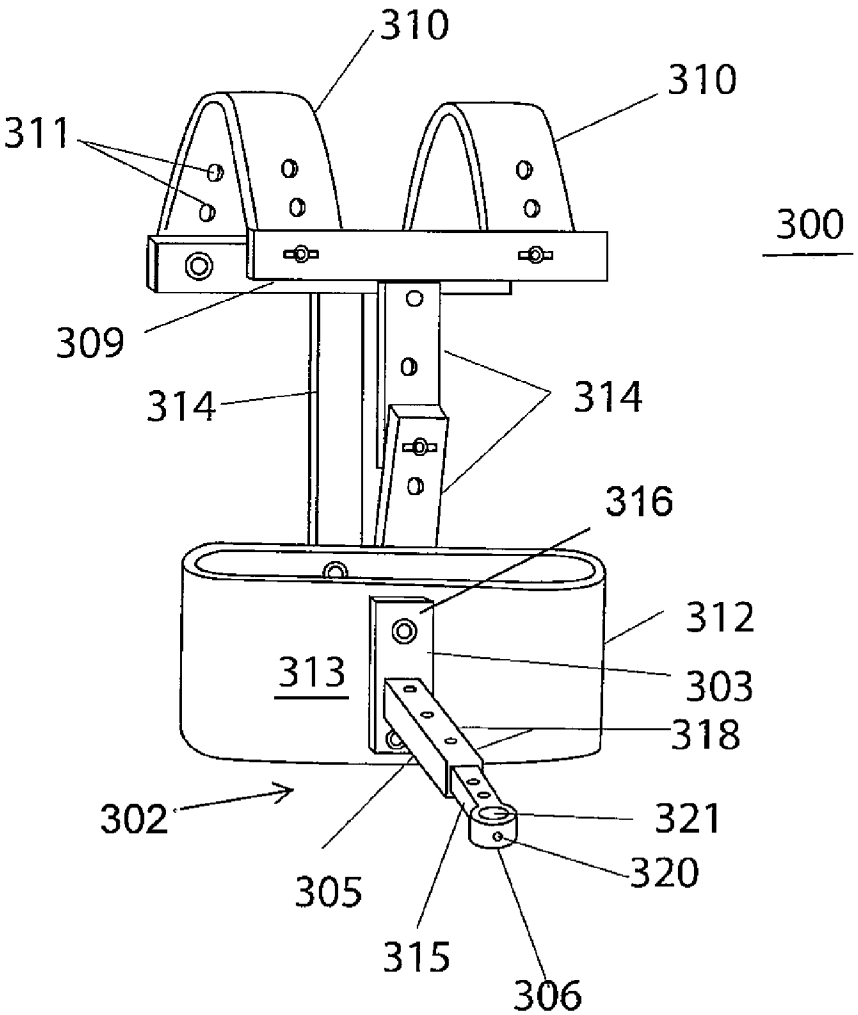
FIG. 6 is a front perspective view of a drum harness in accordance with an embodiment of the present invention.

A drum harness 300 in some embodiment of the present invention, as shown in FIG. 6, includes a pair of shoulder straps 310 forming a yoke, a hip strap 312, and front and back connecting straps 314 that connect the shoulder straps 310 and the hip strap 312. The positions of the straps relative to each other are adjustable, for example, by releasable fasteners 309 inserted through holes 311 formed in the straps, to comfortably fit the person wearing the harness.

Figure 7:
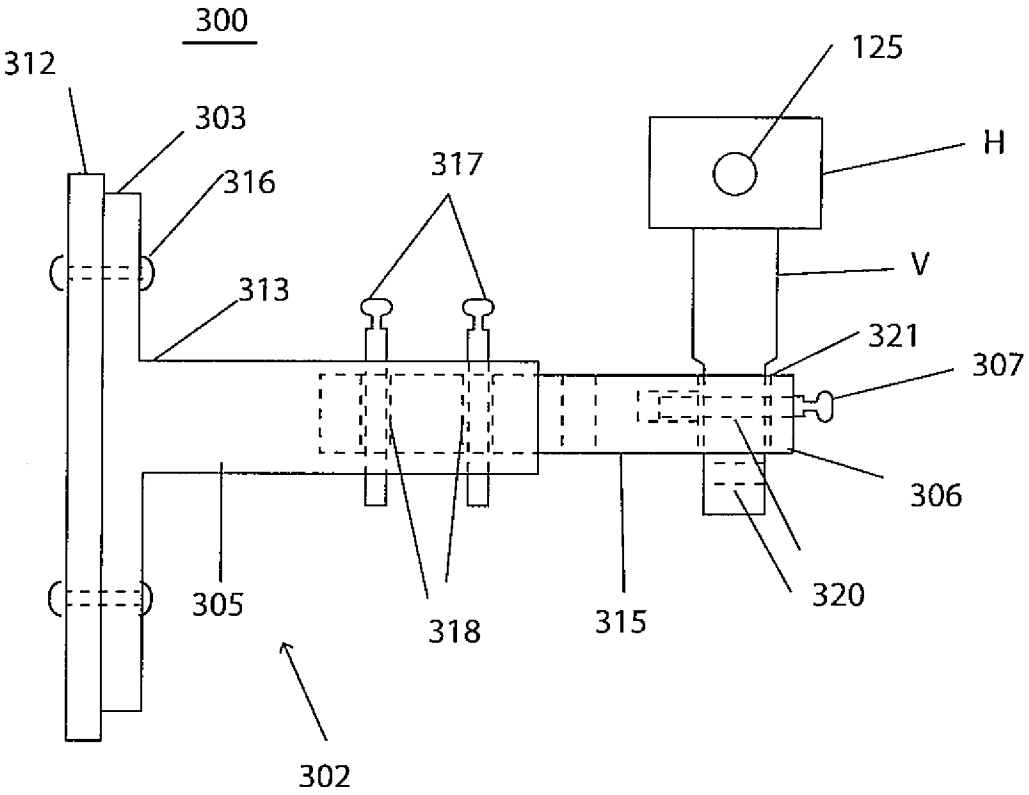
FIG. 7 is a side elevational view of the drum harness of FIG. 6, supporting a connector member.

As also shown in FIG. 7, the harness 300 includes a generally rigid support member 302 that has a mounting plate 303 and a rigid extension arm 305 projecting from the plate 303 in a generally perpendicular direction from the plate 303. The mounting plate 303 is affixed to an outer surface of a frontal region 313 of the hip strap 312, for example, by rivets 316, so that the rigid extension arm 305 is adapted to extend forwardly from the abdominal region of a person wearing the harness. A distal end of the extension arm 305 is configured with a female receiving member 306, for example, a hollow bracket with opening 321, adapted to receive the vertical portion V of the connector member 104. The arm 305 can be releasably secured, for example, by a fastener 307 engaged in apertures 320 formed in the female receiving member 306 and the vertical portion V, which also allows adjustability in the height of the connector member 104 relative to the female receiving member 306.

In some embodiments, the length of the rigid extension arm 305 is adjustable. In the illustrated embodiment of FIG. 6 and FIG. 7, the rigid extension arm 305 includes a telescopic member or rod 315 that is longitudinally movable relative to the arm 305 and can be adjustably locked in a selected position relative to the arm 305, for example, by releasable fastener(s) 317 inserted through holes 318 formed in the arm 305 and the rod 315, for adjusting the distance between the mounting plate 303 and the connector member 104.

Whether the instrument of the present invention is mounted on a musical stand or carried in a harness, a drummer strikes the rototoms in a generally horizontal direction.

The preceding description has been presented with reference to certain exemplary embodiments of the invention. Workers skilled in the art and technology to which this invention pertains will appreciate that alterations and changes to the described structure may be practiced without meaningfully departing from the principal, spirit and scope of this invention, and that the drawings are not necessarily to scale. Moreover, it is understood that any one feature of an embodiment may be used in lieu of or in addition to feature(s) of other embodiments. Accordingly, the foregoing description should not be read as pertaining only to the precise structures described and illustrated in the accompanying drawings. Rather, it should be read as consistent with and as support for the following claims which are to have their fullest and fairest scope.

What is claimed is:

1. A musical instrument, comprising:
at least a first rototom and a second rototom, each rototom having:
a first hoop supporting a drum head;
a spider support with a second hoop, a tension hoop and an annulus, the tension hoop positioned around the first hoop; and
a generally horizontal shaft portion extending between the first hoop and the second hoop,
wherein the spider support is movable on the shaft portion to vary a separation distance between the first hoop and the second hoop; and
a connector member situated between the annuli of the first and second rototom.

2. The musical instrument of claim 1, wherein the connector member supports each rototom such that their respective drum head face opposite directions.

3. The musical instrument of claim 1, wherein the connector member has a vertical attachment portion.

4. The musical instrument of claim 1, wherein the vertical attachment portion has sections with different diameters.

5. The musical instrument of claim 1, wherein the shaft portion of each rototom is connected to each other.

6. The musical instrument of claim 1, wherein the drum head includes a mesh portion.

7. The musical instrument of claim 6, wherein the mesh portion includes a target pad.

8. A musical instrument, comprising:
at least a first rototom and a second rototom, each rototom having:
a first hoop supporting a drum head;
a spider support with a second hoop, a tension hoop and an annulus, the tension hoop positioned around the first hoop; and
a generally horizontal shaft portion extending between the first hoop and the second hoop and through the annulus,
wherein the spider support is movable on the shaft portion to change a separation distance between the first hoop and the second hoop; and
a connector member situated between the annuli of the first and second rototom, the connector member supporting each shaft portion.

9. The musical instrument of claim 8, wherein the connector member includes a horizontal body and a vertical portion extending from an underside of the horizontal body.

10. The musical instrument of claim 8, wherein the connector member supports each rototom at generally a common elevation.

11. The musical instrument of claim 8, wherein the connector member supports each drum head to face an opposite direction.

12. A musical instrument, comprising:

at least a first rototom and a second rototom, each rototom having:

a first hoop supporting a drum head, the first hoop having a first annulus;

a spider support with a second hoop, a tension hoop and a second annulus, the tension hoop positioned around the first hoop; and a generally horizontal threaded shaft portion extending through at least the first and second annuli, wherein the spider support is rotatable on the shaft portion to change a separation distance between the first and second hoops; and a connector member situated between the respective second annuli of the first and second rototoms, wherein the drum head of the first rototom and the drum head of the second rototom are facing opposite directions.

13. The musical instrument of claim 12, wherein the connector member has a vertical attachment portion.

14. The musical instrument of claim 12, wherein the shaft portion of each rototom is connected to each other.

15. The musical instrument of claim 12, wherein an end of each shaft portion is inserted in the connector member.

16. The musical instrument of claim 12, further comprising a harness.

17. The musical instrument of claim 16, wherein the harness has shoulder straps and a hip strap.

18. The musical instrument of claim 16, wherein the harness has a mounting plate and a rigid extension arm, the rigid extension arm adapted to support the connector member.

19. The musical instrument of claim 13, wherein the vertical portion is adapted for mounting on a stand.

20. The musical instrument of claim 13, wherein the vertical portion is adapted for mounting on a harness.

* * * * *